US010890364B2

(12) United States Patent
Li et al.

(10) Patent No.: US 10,890,364 B2
(45) Date of Patent: Jan. 12, 2021

(54) REFRIGERATOR WITH ICE MAKER

(71) Applicants: HEFEI MIDEA REFRIGERATOR CO., LTD., Hefei (CN); HEFEI HUALING CO., LTD., Hefei (CN); MIDEA GROUP CO., LTD., Foshan (CN)

(72) Inventors: Yu Li, Hefei (CN); Deming Wei, Hefei (CN); Ying Jia, Hefei (CN); Wei Chen, Hefei (CN); Dongxian Liu, Hefei (CN); Xuezai Zheng, Hefei (CN); Wei Ren, Hefei (CN)

( * ) Notice: Subject to any disclaimer, the term of this patent is extended or adjusted under 35 U.S.C. 154(b) by 0 days.

(21) Appl. No.: 16/789,444

(22) Filed: Feb. 13, 2020

(65) Prior Publication Data

US 2020/0182522 A1 Jun. 11, 2020

Related U.S. Application Data

(63) Continuation of application No. 16/698,975, filed on Nov. 28, 2019, which is a continuation of application No. PCT/CN2018/125734, filed on Dec. 29, 2018.

(30) Foreign Application Priority Data

Nov. 28, 2018 (CN) ..... 2018 1 1436000

(51) Int. Cl.
*F25C 1/00* (2006.01)
*F25C 5/182* (2018.01)
(Continued)

(52) U.S. Cl.
CPC ..... *F25C 1/00* (2013.01); *F25C 5/182* (2013.01); *F25D 11/02* (2013.01); *F25D 17/065* (2013.01); *F25D 17/067* (2013.01)

(58) Field of Classification Search
CPC ..... F25C 1/00; F25C 5/182; F25D 17/065; F25D 17/067; F25D 11/02
(Continued)

(56) References Cited

U.S. PATENT DOCUMENTS 5,460,010 A * 10/1995 Kobayashi ..... F25D 17/045 62/187
2006/0168996 A1* 8/2006 Imai ..... F04C 29/005 62/510
(Continued)

FOREIGN PATENT DOCUMENTS

CN 101903718 A 12/2010
CN 101903718 A * 12/2010 ..... F25C 1/08
(Continued)

OTHER PUBLICATIONS

International Search Report in the corresponding International Application No. PCT/CN2018/125734.

*Primary Examiner* — Steve S Tanenbaum
(74) *Attorney, Agent, or Firm* — Kilpatrick Townsend & Stockton, LLP

(57) ABSTRACT

The present disclosure relates to the field of household appliances technologies, and discloses a refrigerator with an ice maker, at least comprising: a refrigerating compartment and an ice-making chamber disposed inside the refrigerating compartment, wherein an ice maker is arranged inside the ice-making chamber, the ice-making chamber is supplied with cold air by an ice-making refrigeration system including an ice-making evaporator, an ice-making air duct, and an ice-making fan, the ice-making evaporator is communicated with the ice maker through the ice-making air duct to form a refrigerating circulation loop, the ice-making fan is arranged in the ice-making air duct, and the ice-making
(Continued)

evaporator is disposed outside the ice-making chamber and located inside the refrigerating compartment.

9 Claims, 4 Drawing Sheets

(51) Int. Cl.
*F25D 11/02* (2006.01)
*F25D 17/06* (2006.01)

(58) Field of Classification Search
USPC ..... 62/344
See application file for complete search history.

(56) References Cited

U.S. PATENT DOCUMENTS

| | | | | |
|---|---|---|---|---|
| 2008/0134708 | A1 | 6/2008 | Lee et al. | |
| 2008/0148761 | A1 | 6/2008 | Venkatakrishnan et al. | |
| 2010/0050680 | A1* | 3/2010 | Venkatakrishnan | F25D 17/065 62/340 |
| 2011/0011106 | A1 | 1/2011 | Ahn et al. | |
| 2017/0059224 | A1* | 3/2017 | Bae | F25D 11/006 |
| 2017/0205132 | A1 | 7/2017 | Nuss et al. | |
| 2018/0120016 | A1* | 5/2018 | Maxwell | F25D 17/045 |

FOREIGN PATENT DOCUMENTS

| | | | | | |
|---|---|---|---|---|---|
| CN | 102425898 | A | | 4/2012 | |
| CN | 102818414 | A | | 12/2012 | |
| CN | 102818414 | A | * | 12/2012 | F25D 17/065 |
| CN | 106196827 | A | | 12/2016 | |
| CN | 106885420 | A | | 6/2017 | |
| CN | 207019365 | U | | 2/2018 | |
| CN | 207741397 | U | | 8/2018 | |
| CN | 109282554 | A | | 1/2019 | |
| CN | 109341186 | A | | 2/2019 | |
| KR | 20030030961 | A | | 4/2003 | |
| KR | 100716254 | B1 | | 5/2007 | |

* cited by examiner

REFRIGERATOR WITH ICE MAKER

CROSS-REFERENCE TO RELATED APPLICATION

The present disclosure is a Continuation application of U.S. application Ser. No. 16/698,975, filed on Nov. 28, 2019, which claims the priority of Chinese Application No. 2018/11436000.0, filed in the Chinese Patent Office on Nov. 28, 2018, the entireties of which are herein incorporated by reference.

FILED

The present disclosure relates to the field of household appliances technologies, and particularly to a refrigerator with an ice maker.

BACKGROUND

Currently, an ice-making evaporator for providing cold capacity to an ice maker is typically located inside an ice-making chamber. Since the outline dimension of the ice-making chamber cannot be too large (that is, too large dimension occupies volume and affects the normal use of the user), the outline dimension of the ice-making evaporator is also limited, and the heat load demand of the ice maker cannot be better matched, thereby affecting ice-making speed and ice-making amount.

At the same time, the smaller outline dimension of the ice-making evaporator will cause the effective area of the ice-making evaporator to be too small, resulting in poor frost-reducing capacity of the ice-making evaporator. In the actual refrigerating process, it is necessary to heat and defrost frequently to restore refrigerating capacity of the ice-making evaporator. The frequent defrosting of the ice-making evaporator will seriously affect the ice-making speed of the ice maker, resulting in energy loss; at the same time, the surface temperature of the ice cubes in the ice storage bucket will rise, thereby causing ice cubes to be frozen together and affecting the quality of the ice cubes.

SUMMARY

Technical Problems to be Solved

The present disclosure is intended to address at least one of the technical problems existing in the related art or related art.

An object of the present disclosure is to provide a refrigerator with an ice maker which increases the ice-making speed of the ice maker, improves the frost-reducing capacity of the ice-making evaporator, decreases the heating defrosting frequency of the ice-making evaporator, reduces the energy consumption, and improves the surface quality of the ice cubes.

Technical Solutions

In order to solve the technical problems above, an embodiment of the present disclosure provides a refrigerator with an ice maker, at least comprising:

a refrigerating compartment; and an ice-making chamber disposed inside the refrigerating compartment (of course, the refrigerator may further include a freezing compartment, a temperature changing compartment, and the like), wherein an ice maker is arranged inside the ice-making chamber, the ice-making chamber is supplied with cold air by an ice-making refrigeration system;

the ice-making refrigeration system comprises an ice-making evaporator disposed outside the ice-making chamber and located in the refrigerating compartment;

an ice-making air duct; and an ice-making fan disposed in the ice-making air duct;

the ice-making evaporator is communicated with the ice maker through the ice-making air duct to form a refrigerating cycle.

In the present embodiment, the ice-making air duct comprises an ice-making air supply duct in which the ice-making evaporator is located and an ice-making air return duct, the ice-making air supply duct comprises an ice-making air duct sealing surface constructed on an inner surface of a refrigerating compartment liner of the refrigerating compartment and an ice-making air duct cover plate covered outside the ice-making evaporator and being in seal connection with the ice-making air duct sealing surface.

In the embodiment of the present disclosure, sealing ribs protruding inwards the refrigerating compartment liner are formed on the outer edge of the ice-making air duct sealing surface, and the ice-making air duct cover plate is clamped to outer walls of the sealing ribs in a seal manner.

In the embodiment of the present disclosure, the lower end of the ice-making air return duct communicates with the side wall of the ice-making air supply duct below the ice-making evaporator, the upper end of the ice-making air return duct communicates with the bottom of the ice-making chamber, and an ice storage bucket is arranged inside the ice-making chamber below the ice maker.

In the embodiment of the present disclosure, a joint between the ice maker and the ice-making air supply duct is sealed by a sealing structure; and a defrosting heater is disposed in the ice-making air supply duct below the ice-making evaporator.

In the embodiment of the present disclosure, a refrigerating compartment liner sealing plate is disposed at the inner side of the ice-making air duct cover plate, and a gap is left between the refrigerating compartment liner sealing plate and the ice-making air duct cover plate to form the ice-making air return duct.

In the embodiment of the present disclosure, the refrigerating compartment is supplied with cold air by a main refrigeration system, and the main refrigeration system and the ice-making refrigeration system are separately disposed, respectively; the main refrigeration system includes a main evaporator, a main fan, and a refrigerating air duct. The main evaporator supplies cold air to the refrigerating compartment through the refrigerating air duct in which the main fan is disposed.

In the embodiment of the present disclosure, the refrigerating air duct includes an air duct groove formed in an inner surface of the refrigerating compartment liner of the refrigerating compartment and an refrigerating air duct cover plate covered on the surface of the air duct groove in a seal manner, and a refrigerating air outlet communicated with the refrigerating compartment is disposed in the refrigerating air duct cover plate.

In an embodiment of the present disclosure, the main evaporator is disposed in the refrigerating compartment or the freezing compartment of the refrigerator.

In the embodiment of the present disclosure, the overall refrigeration system includes a compressor, a condenser, a control valve, a throttle mechanism, an evaporator, and an air return pipe, which are sequentially disposed on the refrigerant pipeline to form a loop, the throttle mechanism includes a main throttle mechanism and an ice-making throttle mechanism, the evaporator comprising the ice-making evaporator and the main evaporator, the control valve sequentially communicates with the main throttle mechanism and the main evaporator through a first branch pipeline, the control valve sequentially communicates with the ice-making throttle mechanism and the ice-making evaporator through a second branch pipeline;

the first branch pipeline after passing through the main evaporator communicates with the ice-making evaporator, and the ice-making evaporator after passing through the refrigerant pipeline communicates with the air return pipe; alternatively, the first branch pipeline after passing through the main evaporator communicates with the air return pipe, and the second branch pipeline after passing through the ice-making evaporator communicates with the air return pipe.

In an embodiment of the present disclosure, the ice-making throttle mechanism includes a first ice-making throttle mechanism and a second ice-making throttle mechanism, and the first and second ice-making throttle mechanisms are connected with the ice-making evaporator in parallel.

Beneficial Effects

Compared with the prior art, the present disclosure has the following advantages:

an embodiment of the present disclosure provides a refrigerator with an ice maker, an ice-making chamber is disposed in a refrigerating compartment, and an ice maker is disposed in the ice-making chamber, and the ice-making chamber is supplied with cold air by an ice-making refrigeration system, and the ice-making refrigeration system includes an ice-making evaporator, an ice-making air duct, and an ice-making fan, wherein the ice-making evaporator communicates with the ice maker through the ice-making air duct to form a refrigerating cycle, and the ice-making fan is disposed in the ice-making air duct, the ice-making evaporator is located outside the ice-making chamber and is located inside the refrigerating compartment. Since the space in the refrigerating compartment is much larger than the space of the ice-making chamber, it is convenient to install the ice-making evaporator and increase the effective area of the ice-making evaporator, the heat load of the ice maker and the area of the ice-making evaporator are more rationally matched, the ice-making speed of the ice maker is increased, the frost-reducing capacity of the ice-making evaporator is improved, the heating defrosting frequency of the ice-making evaporator is lowered, the energy consumption is reduced, and the surface quality of the ice cubes is improved.

Further, since the ice-making evaporator is disposed outside the ice-making chamber, a defrosting heater of the ice-making evaporator is disposed distal from the ice-making chamber and the ice storage bucket in the ice-making chamber, and thus the heat transfer into the ice-making chamber during the heating and defrosting of the ice-making evaporator, especially the heat transfer into the ice storage bucket is reduced, and ice cubes in the ice storage bucket are prevented from melting on the surfaces of the ice cubes during the heating and defrosting.

Description of the reference numbers

Figure 1:
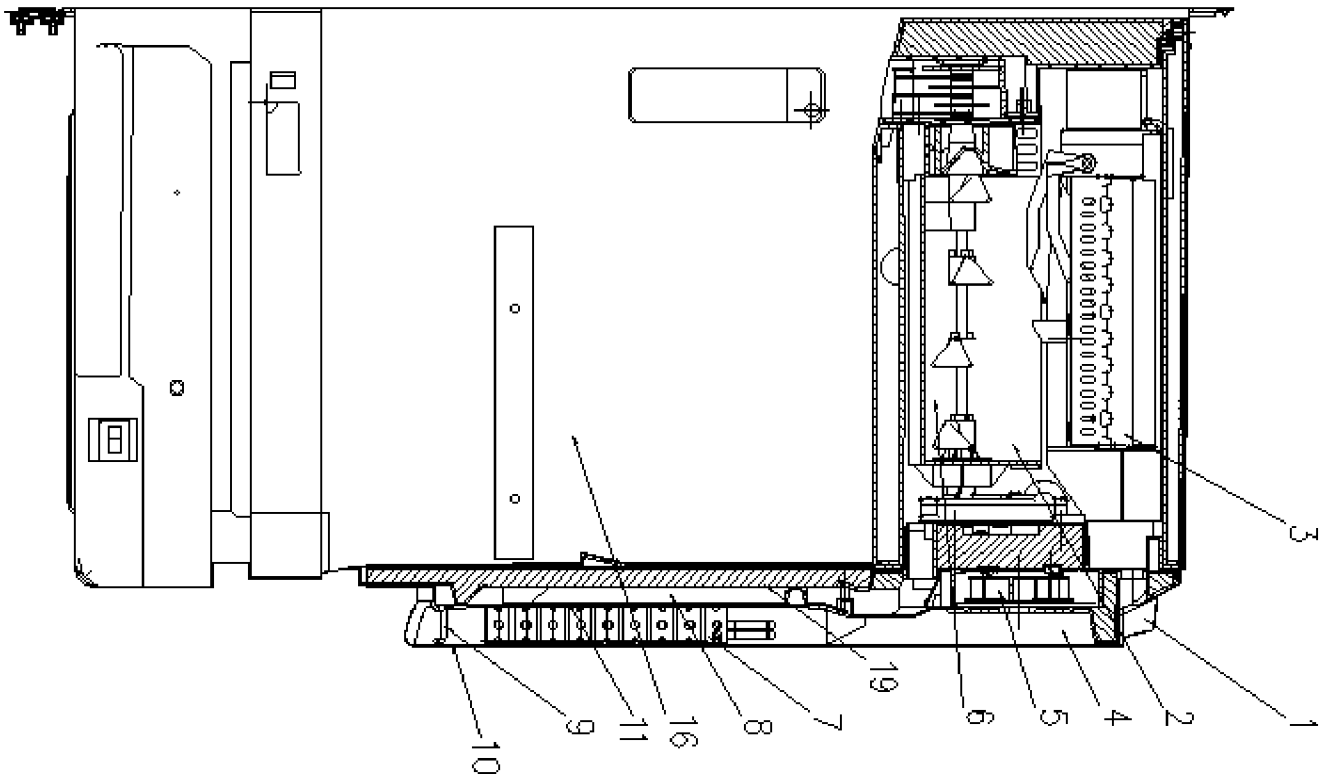
FIG. 1 is an axial cross-sectional view of a refrigerator with an ice maker according to an embodiment of the present disclosure.

| | |
|---|---|
| 1 refrigerator body | 2 ice-making chamber |
| 3 ice maker | 4 ice-making air supply duct |
| 5 ice-making fan | 6 ice storage bucket |
| 7 ice-making evaporator | 8 ice-making air return duct |
| 9 defrosting heater | 10 ice-making air duct sealing surface |
| 11 ice-making air duct cover plate | 12 refrigerating air duct cover plate |
| 13 refrigerating air outlet | 14 main fan |
| 15 main evaporator | 16 refrigerating compartment |
| 17 freezing compartment | 18 sealing rib |
| 19 refrigerating compartment liner sealing plate | 20 air duct groove |

DETAILED DESCRIPTION

The specific implementations of the present disclosure are further described in detail below in conjunction with the drawings and embodiments. The following embodiments are intended to illustrate the disclosure, but are not intended to limit the scope of the disclosure.

In the description of the present disclosure, it is to be noted that the orientation or positional relationships indicated by terms "center", "longitudinal", "lateral", "upper", "lower", "front", "rear", "left", "right", "vertical", "horizontal", "top", "bottom", "inside", "outside", etc. are based on the orientation or positional relationship shown in the drawings, and are merely for the convenience of describing the present disclosure and simplifying the description, rather than indicating or implying that the device or component stated must have a particular orientation or be constructed and operated in a particular orientation, and thus can not to be construed as limiting the disclosure. Moreover, the terms "first", "second", "third", and the like are used for descriptive purposes only and are not to be construed as indicating or implying relative importance.

In the description of the present disclosure, it is to be noted that unless explicitly stated and defined otherwise, the terms "installed," "connected with," and "connected" shall be understood broadly, for example, it may be either fixedly connected or detachably connected, or can be integrated; it may be mechanically connected, or electrically connected; it may be directly connected, or indirectly connected through an intermediate medium, or may be internal communication between two elements. The specific meanings of the terms above in the present disclosure can be understood by a person skilled in the art in accordance with specific conditions.

Further, in the description of the present disclosure, "multiple", "a plurality of", and "multiple groups" mean two or more unless otherwise specified.

Figure 2:
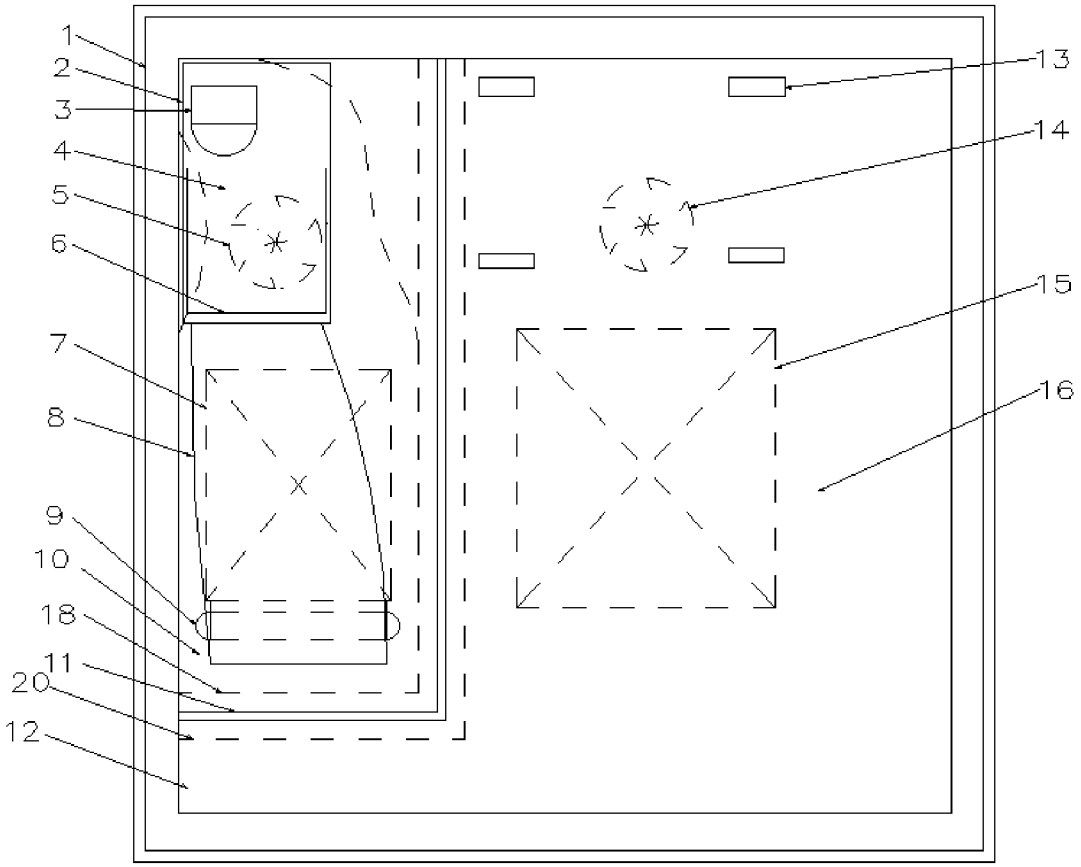
FIG. 2 is a schematic view of a refrigerator with an ice maker according to an embodiment of the present disclosure.
Figure 3:
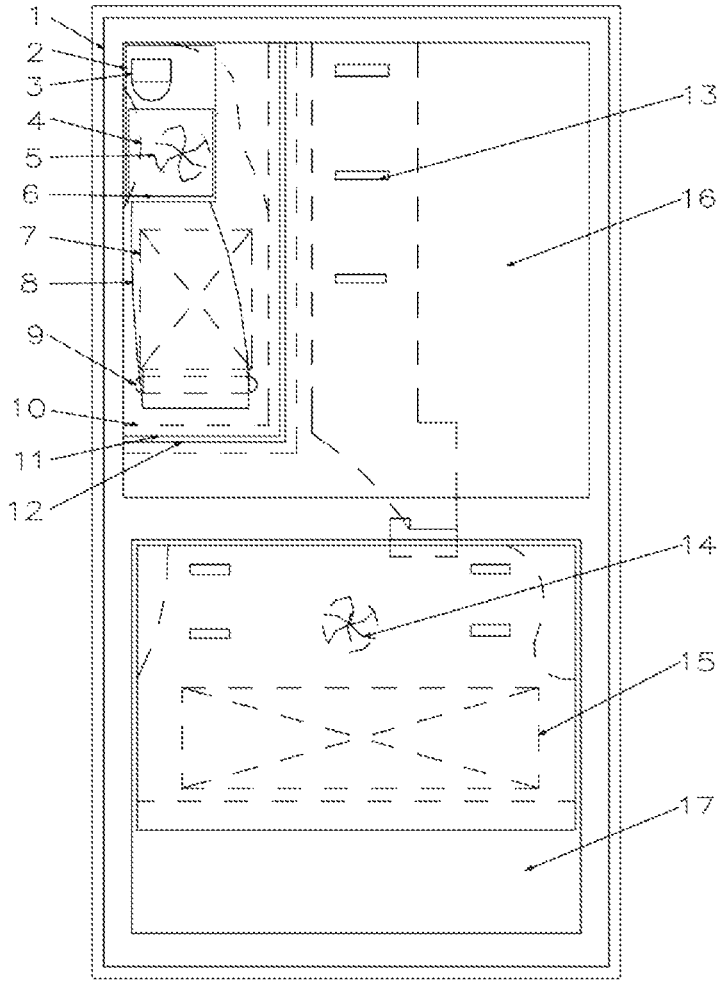
FIG. 3 is a schematic view of a refrigerator with an ice maker according to another embodiment of the present disclosure.

As shown in FIGS. 1-3, an embodiment of the present disclosure provides a refrigerator with an ice maker, comprising a refrigerator body 1 in which at least a refrigerating compartment 16 is disposed. Of course, the refrigerator body 1 may also be provided with a refrigerating compartment, a temperature changing compartment, and the like. The specific form of the refrigerator is not specifically limited, and may be a cross-door refrigerator with a refrigerating compartment above and two compartments below, and the like. An ice-making chamber 2 is disposed in the refrigerating compartment 16, the ice-making chamber 2 is provided with an ice maker 3 and an ice storage bucket 6 located below the ice maker 3 and configured to store ice cubes produced by the ice maker 3, and the ice-making chamber 2 is supplied with cold air by the ice-making refrigeration system, the ice-making refrigeration system specifically comprises an ice-making evaporator 7, an ice-making air duct and an ice-making fan 5, wherein the ice-making evaporator 7 is disposed outside the ice-making chamber 2 and located inside the refrigerating compartment 16, and the ice-making evaporator 7 communicates with the ice maker 3 through the ice-making air duct to form a refrigerating cycle. The ice-making fan 5 is disposed in the ice-making air duct, that is, the cold air of the ice-making evaporator 7 is introduced into the ice maker 3 by the ice-making fan 5 through the ice-making air duct, and is returned to the ice-making evaporator 7 through the ice-making air duct after exchanging heat and the heat exchange is repeated, and the above steps are executed cyclically; and the ice-making fan 5 can speed up the flow speed of the cold air, accelerate the refrigerating cycle and improve cooling efficiency. Since the ice-making evaporator 7 is disposed inside the refrigerating compartment 16 and outside the ice-making chamber 2, the space in the refrigerating compartment 16 is much larger than the space of the ice-making chamber 2, it is convenient to install the ice-making evaporator 7 and increase the effective area of the ice-making evaporator 7, the heat load of the ice maker 3 and the area of the ice-making evaporator 7 are more rationally matched, the ice-making speed of the ice maker 3 is increased, the frost-reducing capacity of the ice-making evaporator 7 is improved, the heating defrosting frequency of the ice-making evaporator 7 is lowered, the energy consumption is reduced, and the surface quality of the ice cubes is improved.

In the embodiment of the present disclosure, specifically, the ice-making air duct includes an ice-making air supply duct and an ice-making air return duct, and the ice-making evaporator 7 is located in the ice-making air supply duct 4, specifically, an air cavity formed by the ice-making evaporator 7 itself may constitute a part of the ice-making air supply duct 4, and the ice-making air supply duct 4 includes an ice-making air duct sealing surface 10 constructed on an inner surface of a refrigerating compartment liner of the refrigerating compartment 16 and an ice-making air duct cover plate 11 covered outside the ice-making evaporator 7 and being in seal connection with the ice-making air duct sealing surface 10, and the ice-making evaporator 7 is pre-installed in the space corresponding to ice-making air duct sealing surface 10, and is then covered with the ice-making air duct cover plate 11 to form the ice-making air supply duct 4, and the ice-making evaporator 7 is spaced from the refrigerating compartment 16 by the ice-making air supply duct 4.

In the embodiment of the present disclosure, specifically, sealing ribs 18 protruding inwards the refrigerating compartment liner are formed on the outer edge of the ice-making air duct sealing surface 10, the sealing ribs 18 have an L shape extending toward a sidewall at one side from the inner surface of the refrigerating compartment liner, and the ice-making air duct cover plate 11 is clamped to the outer walls of the sealing ribs 18 in a seal manner so that the reliable sealing and convenience in connection are achieved.

In the embodiment of the present disclosure, the lower end of the ice-making air return duct 8 communicates with the side wall of the ice-making air supply duct 4 below the ice-making evaporator 7, the upper end of the ice-making air return duct 8 communicates with the bottom of the ice-making chamber 2, the cold air flowing out of the ice-making air supply duct 4 passes through the ice maker 3 and the ice storage bucket 6, and then flows out of the bottom of the ice-making chamber 2, and is introduced to the ice-making air supply duct 4 below the ice-making evaporator 7 through the ice-making air return duct 8, and the cold air heated by the heat exchange fully heat exchanges with the ice-making evaporator 7 from bottom to top to perform rapid cooling, and the cooled cold air is introduced from the ice-making air supply duct into the ice maker 3 by the ice-making fan for a refrigerating cycle.

In the embodiment of the present disclosure, a joint between the ice maker 3 and the ice-making air supply duct 4 is sealed by a sealing structure, which may be a rubber seal ring, a sealing rubber strip and the like, so that air leakage at the joint between the ice maker 3 and the ice-making air supply duct 4 can be effectively reduced, and the air supply efficiency of the ice-making refrigeration system is improved; and a defrosting heater 9 is disposed in the ice-making air supply duct 4 below the ice-making evaporator 7, wherein the defrosting heater 9 may be electric heating wires, electric heating bars and the like. Since the ice-making evaporator 7 is disposed outside the ice-making chamber 2, the defrosting heater 9 of the ice-making evaporator 7 is disposed distal from the ice-making chamber 2 and the ice storage bucket 6 inside the ice-making chamber 2, and thus the heat transfer to the ice-making chamber 2 during the heating and defrosting of the ice-making evaporator 7, especially the heat transfer into the ice storage bucket 6 is reduced, ice cubes in the ice storage bucket 6 are prevented from melting on the surfaces of the ice cubes during the heating and defrosting and surface quality of the ice cubes is improved.

When the ice-making fan 5 is in operation, the cold air of the upper portion of the ice-making evaporator 7 is sucked up through the ice-making air supply duct 4, and then introduced into the ice maker 3 and the ice storage bucket 6 inside the ice-making chamber 2 through the ice-making air supply duct 4; the cold air has raised temperature after refrigerating the ice maker 3 and the ice storage bucket 6, and then passes through the ice-making air return duct 8, and returns to the bottom of the ice-making evaporator 7, is drawn by the ice-making fan 5, passes through the ice-making evaporator 7 while exchanging heat with the ice-making evaporator 7, the air cooled by the ice-making evaporator 7 is drawn again by the ice-making fan 5 into the ice-making air supply duct 4, thereby completing one refrigerating cycle of air supply and air return.

In the embodiment of the present disclosure, a refrigerating compartment liner sealing plate 19 is disposed at the inner side of the ice-making air duct cover plate 11, the term "inner" here is with respect to the refrigerating compartment 16, and refers to a space directing to the inside of the refrigerating compartment 16 while "outer" refers to a space departing from the inside of the refrigerating compartment 16; a gap is left between the refrigerating compartment liner sealing plate 19 and the ice-making air duct cover plate 11 to form the ice-making air return duct 8, and the ice-making air return duct 8 is located at the inner side of the ice-making air duct cover plate 11 and thus the inner surface space of the refrigerating compartment liner is fully utilized.

In the embodiment of the present disclosure, the refrigerating compartment 16 is supplied with cold air by a main refrigeration system, and the main refrigeration system and the ice-making refrigeration system are separately disposed, respectively; the main refrigeration system includes a main evaporator 15, a main fan 14, and a refrigerating air duct. The main evaporator 15 supplies the refrigerating compartment 16 with cold air through the refrigerating air duct in which the main fan 14 is disposed and thus the cold air supply speed is accelerated and the refrigerating efficiency is improved. Specifically, the refrigerating air duct includes an air duct groove 20 formed in an inner surface of the refrigerating compartment liner of the refrigerating compartment 16 and an refrigerating air duct cover plate 12 covered on the surface of the air duct groove 20 in a seal manner, and a refrigerating air outlet 13 communicated with the refrigerating compartment 16 is disposed in the refrigerating air duct cover plate 12 and the cold air is blown from the refrigerating air outlet 13 toward the refrigerating compartment 16.

In the embodiment of the present disclosure, as shown in FIG. 2, the main evaporator 15 can be disposed in the refrigerating compartment 16 of the refrigerator while the refrigerating compartment 16 is supplied with cold air by the main evaporator 15 as shown. Of course, as shown in FIG. 3, the main evaporator 15 can also be disposed in the freezing compartment 17 of the refrigerator while the refrigerating compartment 16 is supplied with cold air by the main evaporator 15 located inside the freezing compartment 17.

Figure 4:
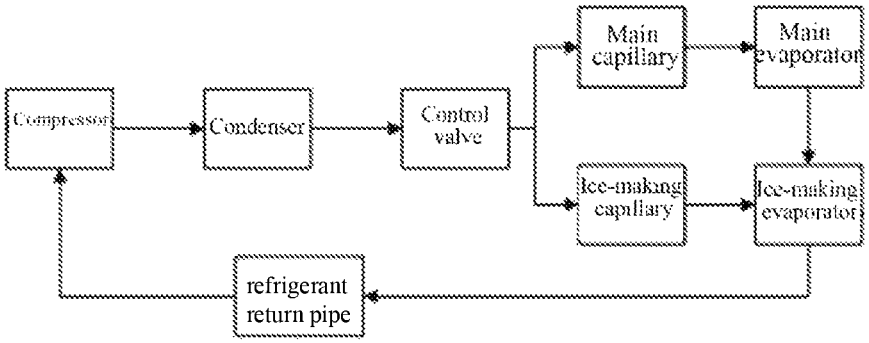
FIG. 4 is a block diagram showing the connection of an overall refrigeration system in a refrigerator with an ice maker according to an embodiment of the present disclosure.
Figure 5:
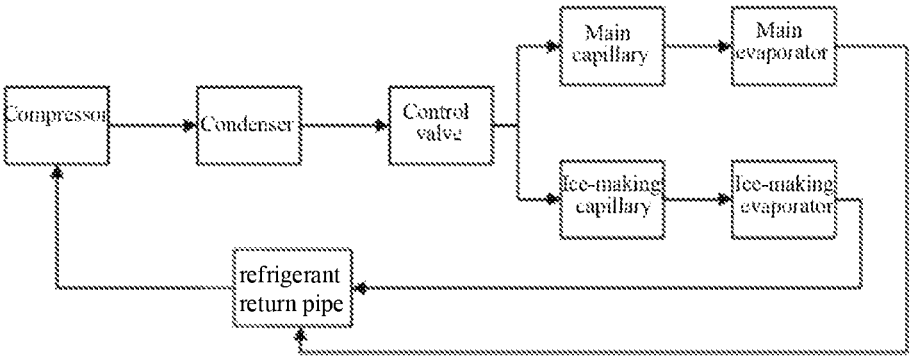
FIG. 5 is a block diagram showing the connection of an overall refrigeration system in a refrigerator with an ice maker according to another embodiment of the present disclosure.
Figure 6:
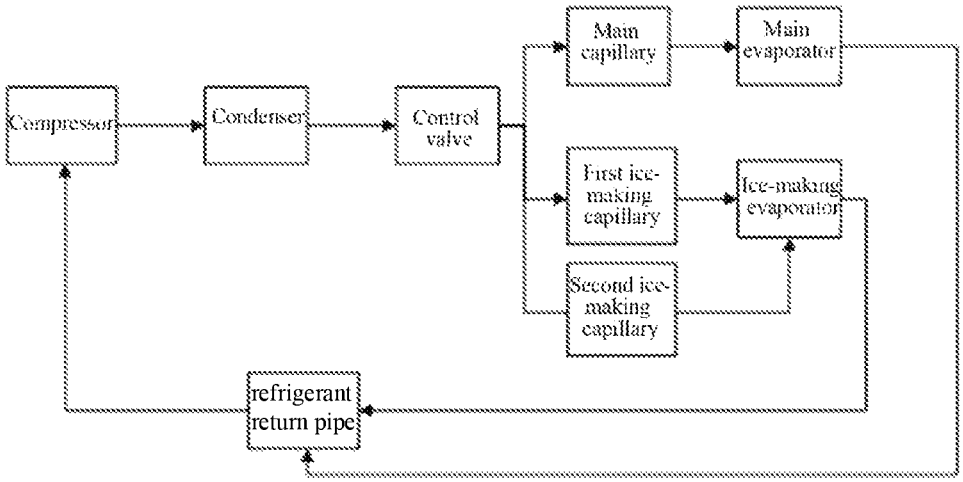
FIG. 6 is a block diagram showing the connection of an overall refrigeration system in a refrigerator with an ice maker according to a third embodiment of the present disclosure.

In the embodiment of the present disclosure, as shown in FIGS. 4 to 6, the overall refrigeration system includes a compressor, a condenser, a control valve, a throttle mechanism, an evaporator, and an air return pipe, which are sequentially disposed on the refrigerant pipeline to form a loop, the throttle mechanism includes a main throttle mechanism and an ice-making throttle mechanism, the evaporator comprises the ice-making evaporator and the main evaporator, the control valve sequentially communicates with the main throttle mechanism and the main evaporator through a first branch pipeline, the control valve sequentially communicates with the ice-making throttle mechanism and the ice-making evaporator through a second branch pipeline. In the present embodiment, the main throttle mechanism can be a system capillary while the ice-making throttle mechanism may be either an ice-making capillary or a throttle mechanism such as an expansion valve;

As shown in FIG. 4, the first branch pipeline after passing through the main evaporator communicates with the ice-making evaporator, and the ice-making evaporator after passing through the refrigerant pipeline communicates with the air return pipe, and the main evaporator and the ice-making evaporator form a parallel-then-series connection mode;

When the ice-making evaporator requests for refrigerating, if the main evaporator has no request for refrigerating, the control valve leads to the ice-making capillary, the ice-making evaporator refrigerates independently, and the ice-making evaporator can provide a lower evaporation temperature, which is advantageous for accelerating ice-making speed;

When the ice-making evaporator requests for refrigerating, if the main evaporator requests for refrigerating also, the control valve leads to the system capillary, and the main evaporator and the ice-making evaporator simultaneously refrigerate; thus both the refrigerating demand of the main evaporator can be satisfied, and the ice-making evaporator can be refrigerated;

When the ice-making evaporator does not request for refrigerating, if the main evaporator requests for refrigerating, the control valve leads to the system capillary, the main evaporator refrigerates, while the ice-making fan is controlled to be closed, and although the refrigerant flows through the inside of the ice-making evaporator for refrigerating, the ice-making evaporator does not refrigerate the ice-making chamber since the ice-making fan is in a closed state, at the same time, the ice-making evaporator only plays a role in connecting the main evaporator and the air return pipe;

When the ice-making evaporator has no request for refrigerating, if the main evaporator has no request for refrigerating either, the direction of control valve is unchanged, and the entire refrigeration system stops refrigerating.

Alternatively, as shown in FIG. 5, the first branch pipeline after passing through the main evaporator communicates with the air return pipe, the second branch pipeline after passing through the ice-making evaporator communicates with the air return pipe, and the main evaporator and the ice-making evaporator form a pure-parallel connection mode. When the ice-making evaporator requests for refrigerating, and the main evaporator requests for refrigerating also, the control valve leads to the system capillary, and the main evaporator refrigerates, at the same time, the main evaporator can provide a relatively higher evaporation temperature, thereby improving system efficiency and reducing energy consumption;

When the ice-making evaporator requests for refrigerating, and the main evaporator does not request for refrigerating, the control valve leads to the ice-making capillary, and the ice-making evaporator refrigerates, at the same time, the ice-making evaporator can provide a relatively lower evaporation temperature, thereby improving the ice-making speed;

When the ice-making evaporator has no request for refrigerating, and the main evaporator has a request for refrigerating, the control valve leads to the system capillary, and the main evaporator refrigerates, at the same time, the main evaporator can provide a relatively higher evaporation temperature, thereby improving system efficiency and reducing energy consumption;

when the ice-making evaporator has no request for refrigerating, and the main evaporator has no request for refrigerating either, the direction of control valve is unchanged, and the entire refrigeration system stops refrigerating.

In the embodiment of the present disclosure, as shown in FIG. 6, when the main evaporator and the ice-making evaporator are connected in pure parallel, the ice-making evaporator may also be connected by a double ice-making throttle mechanism, and the ice-making throttle mechanism includes a first ice-making throttle mechanism and a second ice-making throttle mechanism, which may specifically be a first ice-making capillary and a second ice-making capillary, and the first ice-making throttle mechanism and the second ice-making throttle mechanism are connected in parallel with the ice-making evaporator to be configured to provide different evaporation temperatures to the ice-making evaporator. When the ice-making evaporator requests for refrigerating, and the main evaporator requests for refrigerating also, the control valve leads to the system capillary, and the main evaporator refrigerates, at the same time, the main evaporator can provide a relatively higher evaporation temperature, thereby improving system efficiency and reducing energy consumption;

When the ice-making evaporator requests for refrigerating and the main evaporator does not request for refrigerating, if the ice maker requests for ice making, the control valve leads to the first ice-making capillary, and the ice-making evaporator refrigerates, at the same time, the specification of the first ice-making capillary can be adjusted to allow the ice-making evaporator to provide a relatively low evaporation temperature, thereby improving the ice-making speed;

When the ice-making evaporator requests for refrigerating and the main evaporator does not request for refrigerating, if the ice maker has no request for ice making, the control valve leads to the second ice-making capillary, and the ice-making evaporator refrigerates, at the same time, the specification of the second ice-making capillary can be adjusted to allow the ice-making evaporator to provide a relatively higher evaporation temperature, and the refrigeration of the ice-making evaporator can only maintain the temperature of the ice-making evaporator, thereby improving system efficiency and reducing energy consumption;

When the ice-making evaporator has no request for refrigerating, and the main evaporator has a request for refrigerating, the control valve leads to the system capillary, and the main evaporator refrigerates, at the same time, the main evaporator can provide a relatively higher evaporation temperature, thereby improving system efficiency and reducing energy consumption;

when the ice-making evaporator has no request for refrigerating, and the main evaporator has no request for refrigerating either, the direction of control valve is unchanged, and the entire refrigeration system stops refrigerating.

As can be seen from the above embodiments, the present disclosure can more reasonably match the heat load of the ice maker and the area of the ice-making evaporator, increases the ice-making speed of the ice maker, improves the frost-reducing capacity of the ice-making evaporator, decreases the heating defrosting frequency of the ice-making evaporator, reduces the energy consumption, and improves the surface quality of the ice cubes.

The embodiments above are only the preferred embodiments of the present disclosure, and are not intended to limit the disclosure. Any modifications, equivalent substitutions, improvements, etc., which are within the spirit and principles of the present disclosure, should be included in the protection scope of the present disclosure.

What is claimed is:

1. A refrigerator with an ice maker, comprising:

a refrigerating compartment; and an ice-making chamber disposed inside the refrigerating compartment, wherein the ice maker is provided inside of the ice-making chamber, the ice-making chamber is refrigerated by an ice-making refrigeration system;

wherein the ice-making refrigeration system includes:

an ice-making evaporator disposed outside of the ice-making chamber;

an ice-making air duct; and an ice-making fan disposed in the ice-making air duct;

the ice-making evaporator is air communicated with the ice maker through the ice-making air duct to form a refrigerating cycle;

wherein the ice-making air duct comprises an ice-making air supply duct configured to include the ice-making evaporator, and an ice-making air return duct; an outlet of the ice-making air return duct communicates with an inlet of the ice-making air supply duct below the ice-making evaporator, and an ice storage bucket is provided inside of the ice-making chamber below the ice maker;

wherein an outlet of the ice-making air supply duct and the ice maker are above an inlet of the ice-making air return duct and the ice storage bucket in the ice-making chamber;

wherein the refrigerating compartment is refrigerated by a main refrigeration system, and the main refrigeration system and the ice-making refrigeration system are separately disposed;

the main refrigeration system includes a main evaporator configured to refrigerate the refrigerating compartment, a main fan, and a refrigerating air duct configured to include the main evaporator and the main fan;

wherein the ice-making evaporator and the main evaporator are provided in the refrigerating compartment above a freezing compartment of the refrigerator;

wherein the ice-making air supply duct and the ice-making air return duct are provided outside of the ice-making chamber and on back of the refrigerator; the ice-making air supply duct is provided on top of the ice-making air return duct the ice-making evaporator is provided upstream of the ice-making air supply duct.

2. The refrigerator with an ice maker of claim 1, wherein the ice-making air supply duct comprises an ice-making air duct sealing surface provided on an inner surface of a refrigerating compartment liner, and an ice-making air duct cover plate configured to cover the ice-making evaporator and being in seal connection with the ice-making air duct sealing surface.

3. The refrigerator with an ice maker of claim 2, wherein sealing ribs protruding inwards the refrigerating compartment liner are formed on the outer edge of the ice-making air duct sealing surface, and the ice-making air duct cover plate is clamped to outer walls of the sealing ribs in a seal manner.

4. The refrigerator with an ice maker of claim 2, wherein a joint between the ice-making chamber and the ice-making air supply duct is sealed by a seal ring; and a defrosting heater is disposed in the ice-making air supply duct below the ice-making evaporator.

5. The refrigerator with an ice maker of claim 2, wherein a refrigerating compartment liner sealing plate is disposed at the inner side of the ice-making air duct cover plate, and a gap is left between the refrigerating compartment liner sealing plate and the ice-making air duct cover plate to form the ice-making air return duct.

6. The refrigerator with an ice maker of claim 1, wherein the main refrigeration system further comprises a compressor, a condenser, a control valve, a throttle and a refrigerant return pipe, which are sequentially disposed to form a loop, wherein the throttle includes a main throttle and an ice-making throttle;

the control valve sequentially communicates with the main throttle and the main evaporator through a first branch pipeline, the control valve sequentially communicates with the ice-making throttle and the ice-making evaporator through a second branch pipeline;

the first branch pipeline communicates with the ice-making evaporator after passing through the main evaporator, and the ice-making evaporator communicates with the refrigerant return pipe.

7. The refrigerator with an ice maker of claim 6, wherein the ice-making throttle includes a first ice-making throttle and a second ice-making throttle, and the first and second ice-making throttles are connected with the ice-making evaporator in parallel.

8. The refrigerator with an ice maker of claim 1, wherein the main refrigeration system includes a compressor, a condenser, a control valve, a throttle, and a refrigerant return pipe, which are sequentially disposed to form a loop, wherein the throttle includes a main throttle and an ice-making throttle;

the control valve sequentially communicates with the main throttle and the main evaporator through a first branch pipeline, the control valve sequentially communicates with the ice-making throttle and the ice-making evaporator through a second branch pipeline;

the first branch pipeline communicates with the refrigerant return pipe after passing through the main evaporator, and the second branch pipeline communicates with the refrigerant return pipe after passing through the ice-making evaporator.

9. The refrigerator with an ice maker of claim 8, wherein the ice-making throttle includes a first ice-making throttle and a second ice-making throttle, and the first and second ice-making throttles are connected with the ice-making evaporator in parallel.

* * * * *